US007175731B2

(12) United States Patent
Hansen et al.

(10) Patent No.: US 7,175,731 B2
(45) Date of Patent: Feb. 13, 2007

(54) METHOD OF MANUFACTURING SHEETS BEING ABLE TO TEAR OFF

(75) Inventors: Christian Hansen, Saltdjö-Boo (SE); Fredrik Hansen, Saltsjö-Boo (SE)

(73) Assignee: Panorama Press AB, Stockholm (SE)

( * ) Notice: Subject to any disclaimer, the term of this patent is extended or adjusted under 35 U.S.C. 154(b) by 0 days.

(21) Appl. No.: 10/475,712

(22) PCT Filed: Apr. 18, 2002

(86) PCT No.: PCT/SE02/00708

§ 371 (c)(1),
(2), (4) Date: Oct. 23, 2003

(87) PCT Pub. No.: WO02/085584

PCT Pub. Date: Oct. 31, 2002

(65) Prior Publication Data

US 2004/0134320 A1 Jul. 15, 2004

(30) Foreign Application Priority Data

Apr. 24, 2001 (SE) ..... 0101474-5

(51) Int. Cl.
*B26D 3/12* (2006.01)

(52) U.S. Cl. ..... 156/257; 83/875; 83/880; 83/51; 428/43

(58) Field of Classification Search ..... 156/257, 156/268; 428/43; 83/51, 875, 876, 879, 83/880
See application file for complete search history.

(56) References Cited

U.S. PATENT DOCUMENTS 2,681,732 A * 6/1954 Brady ..... 206/447
3,032,463 A * 5/1962 Morgan ..... 156/253
3,185,578 A * 5/1965 Scharre ..... 426/114
4,447,481 A * 5/1984 Holmberg et al. ..... 428/41.7
4,590,109 A * 5/1986 Holmberg ..... 428/41.7
5,114,774 A 5/1992 Ogg et al.
5,824,379 A 10/1998 Riley et al.
6,146,731 A * 11/2000 Tanoto ..... 428/43

FOREIGN PATENT DOCUMENTS

| | | |
|---|---|---|
| DE | 3215471 | 10/1983 |
| DE | 19715548 | 10/1998 |
| EP | 0820843 | 1/1998 |

* cited by examiner

*Primary Examiner*—Richard Crispino
*Assistant Examiner*—Barbara J Musser
(74) *Attorney, Agent, or Firm*—Banner & Witcoff, Ltd.

(57) ABSTRACT

The present invention relates to a method of manufacturing tearable sheets, wherewith each sheet obtains a perfectly smooth tear edge when torn-off. The method comprises the steps of: punching each sheet transversely of the fibers of said sheet from a first side of the sheet to an extend corresponding to a firs portion of the thickness of the sheet; and punching each sheet transversely of the fibers of said sheet from a second side of the sheet to an extent corresponding to a second portion of the thickness of said sheet; wherein the sum of said first thickness portion and said second thickness portion is smaller than the thickness of the sheet, and wherein the second punching operation is performed parallel with the first punching operation but displaced in a plane parallel with said first and said second sides of the sheet, said displacement being adapted for tear-off purposes.

16 Claims, 9 Drawing Sheets

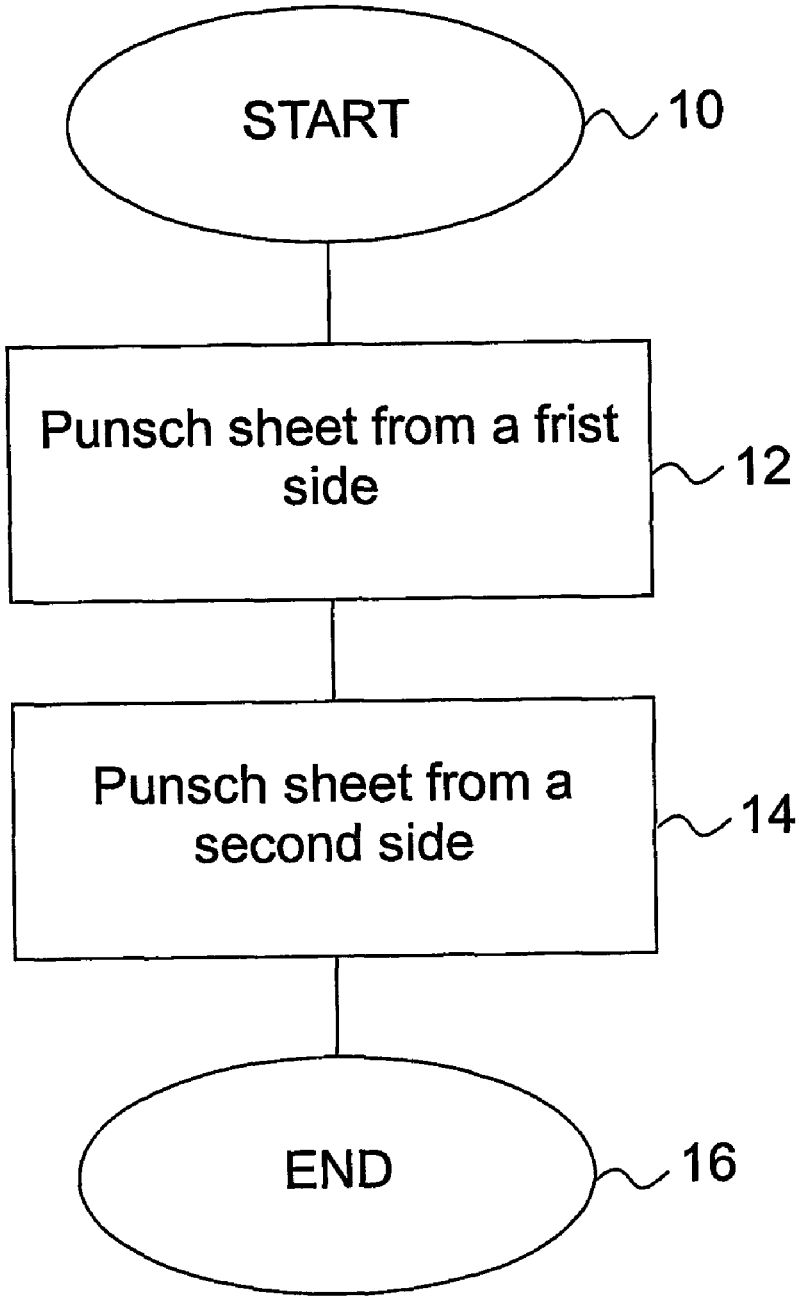
Figur 1

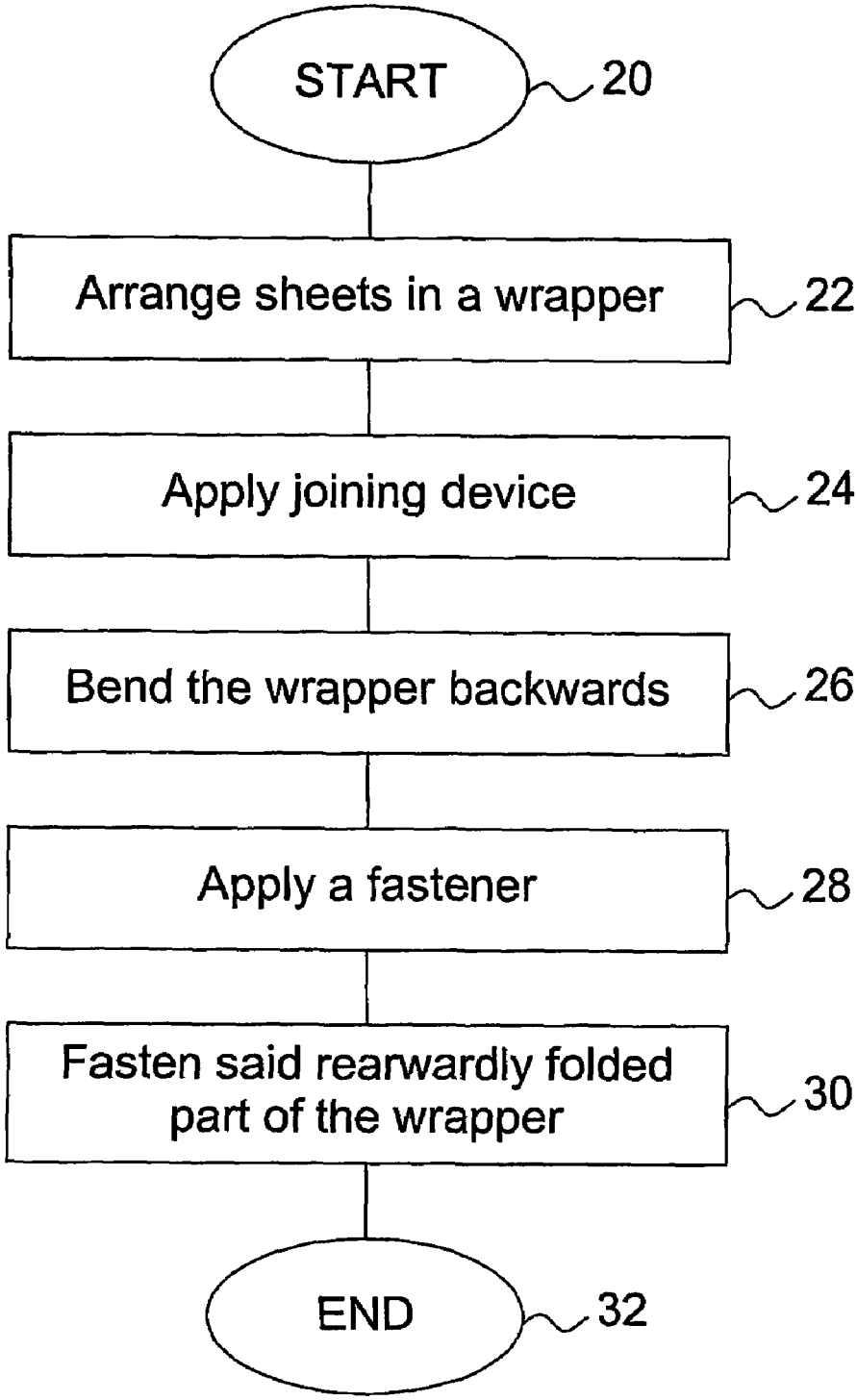
Figur 2

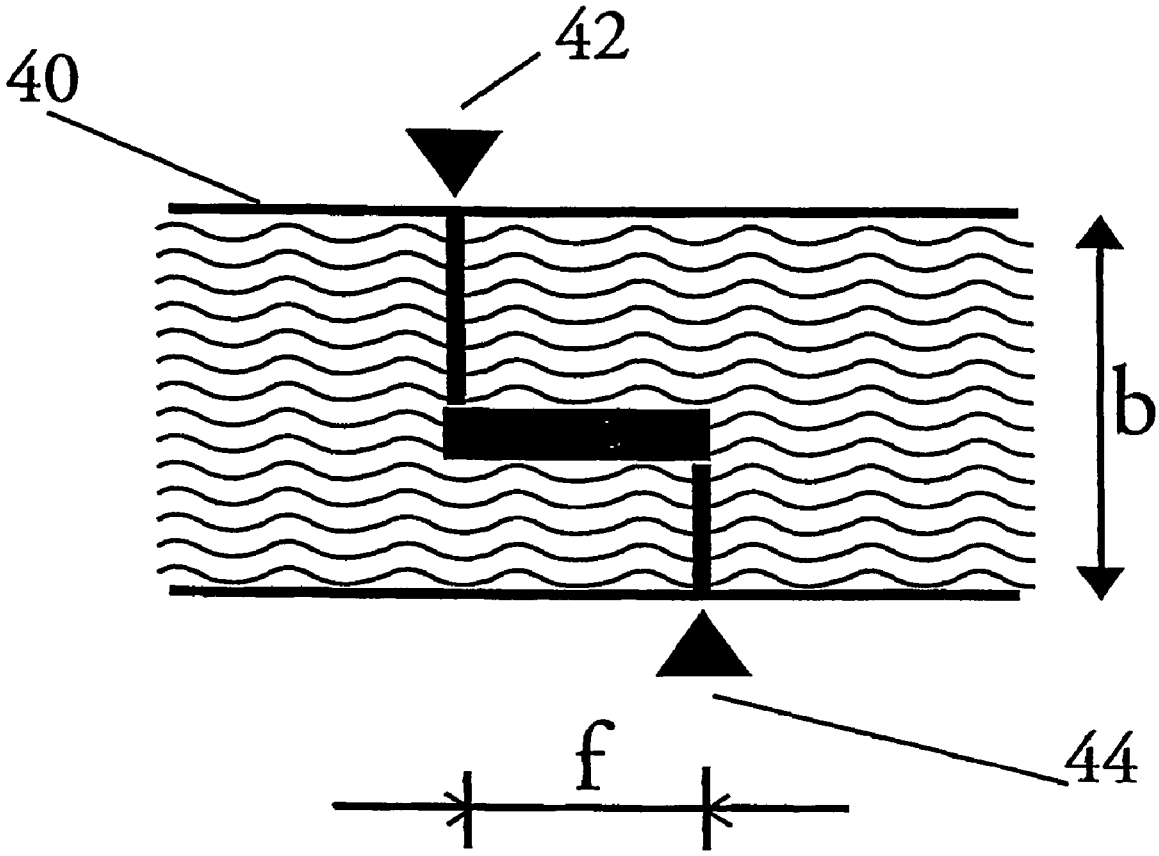
Figur 3

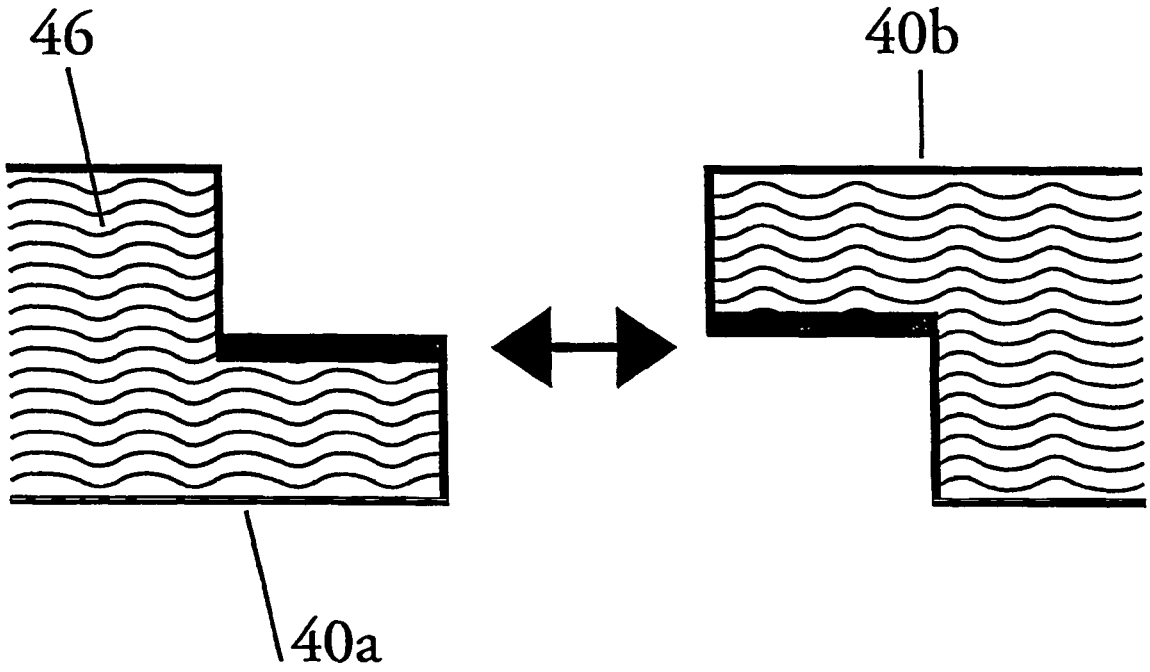
Figur 4

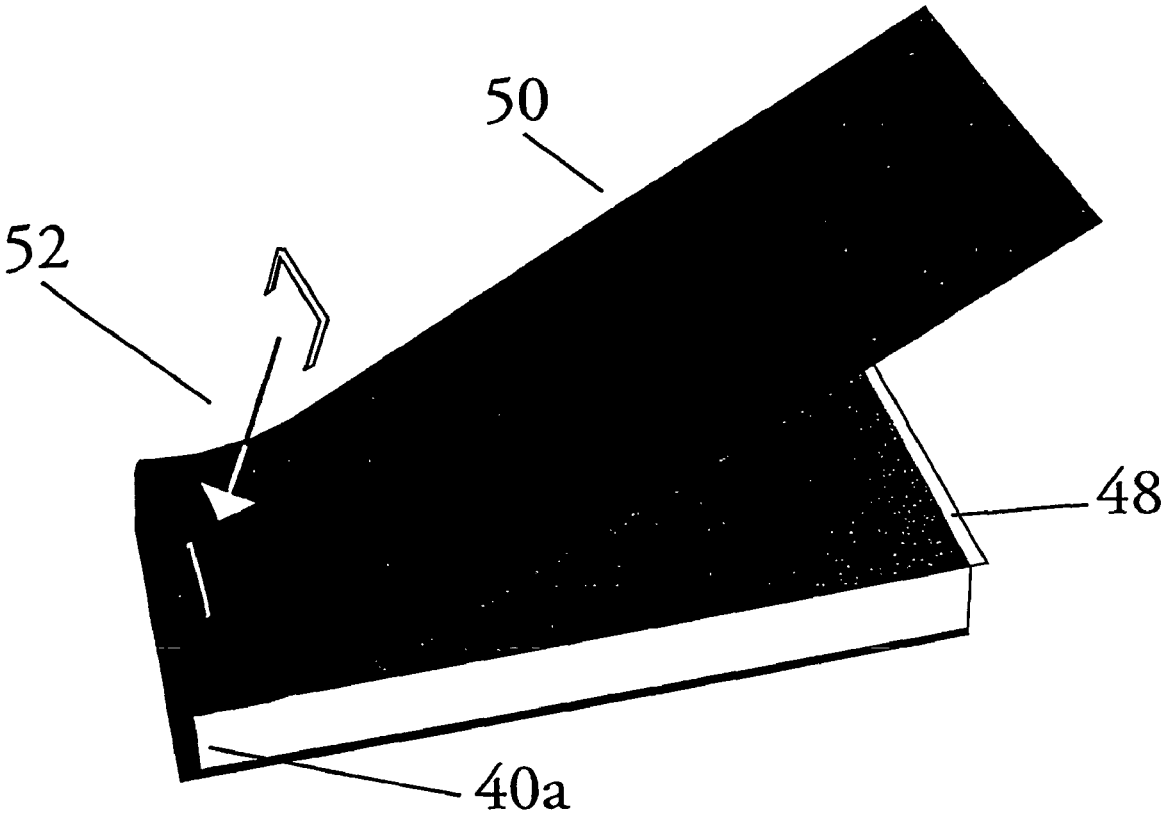
Figur 5

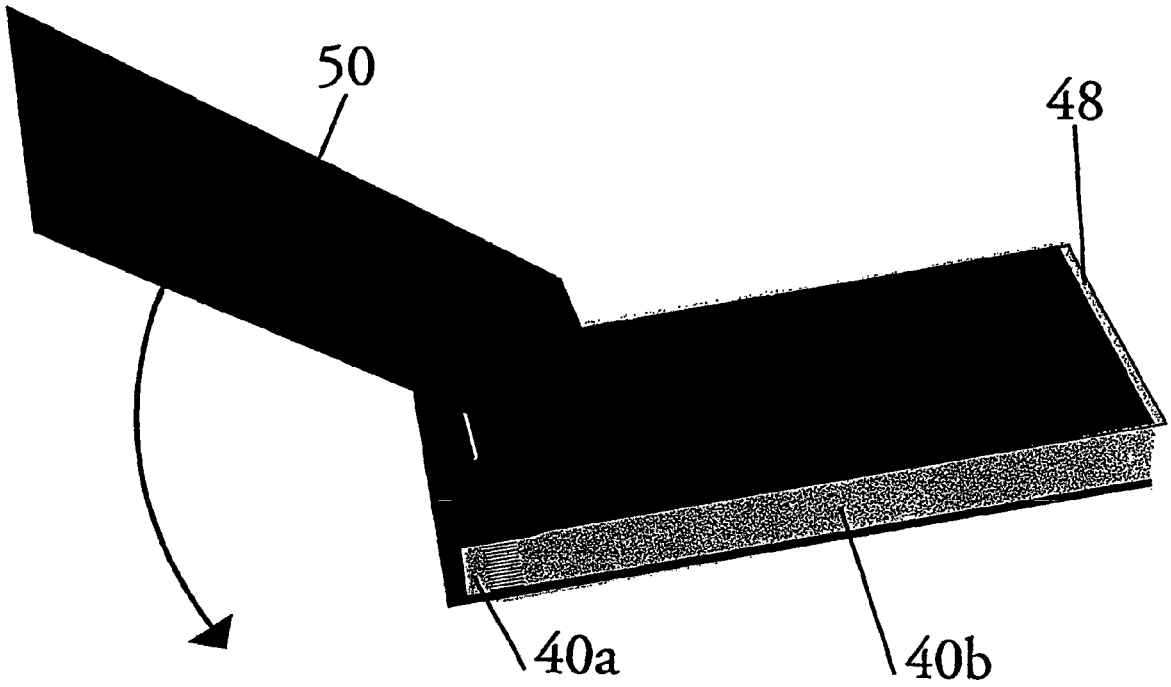
Figur 6

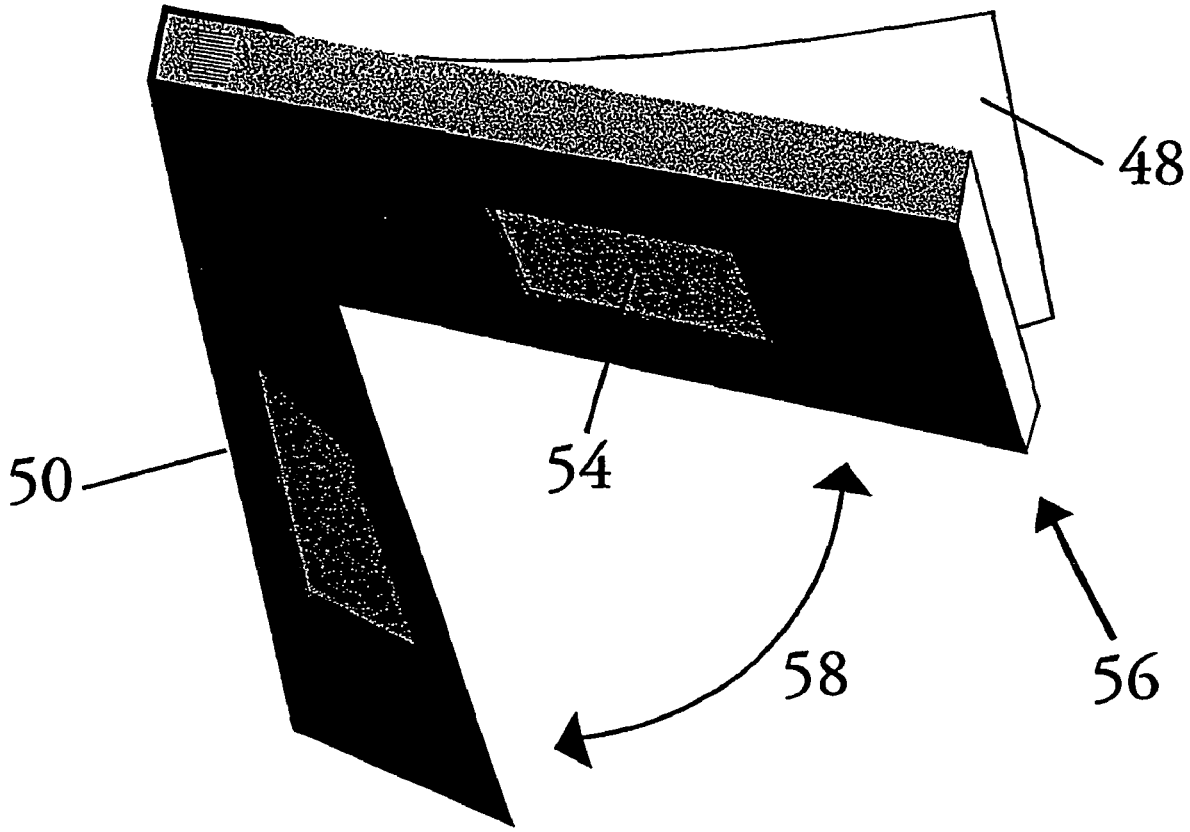
Figur 7

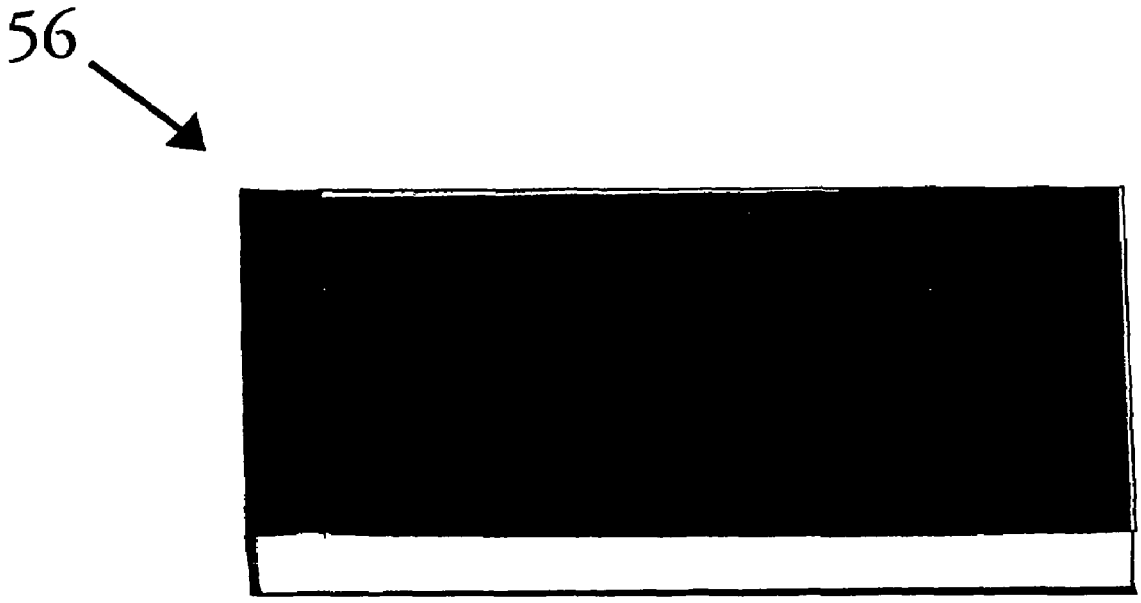
Figur 8

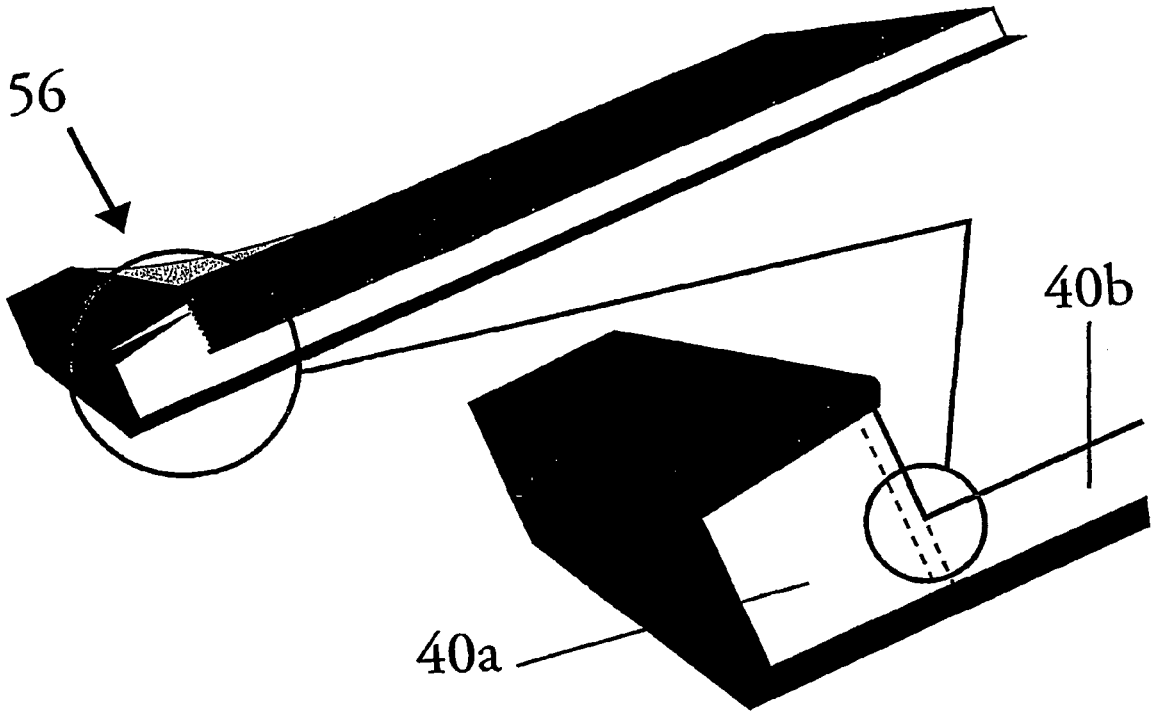
Figur 9

METHOD OF MANUFACTURING SHEETS BEING ABLE TO TEAR OFF

This application is a National Stage application of co-pending PCT application PCT/SE02/00708 filed Apr. 18, 2002, which was published in English under PCT Article 21(2) on Oct. 31, 2002, which claims the benefit of Sweden application Ser. No. 0101474-5 filed Apr. 24, 2001. These applications are incorporated herein by reference in their entireties.

TECHNICAL FIELD

According to one aspect, the present invention relates to a method of manufacturing tearable sheets.

According to a second aspect, the present invention relates to a method of manufacturing a pad or block that comprises tearable sheets.

According to a third aspect, the present invention relates to a pad or block manufactured in accordance with the method.

BACKGROUND OF THE INVENTION

In certain aspects, it may be practical to arrange visiting cards in the form of a block or pad from which individual visiting cards can be torn off, one at a time. This is made possible by perforating the cards. A serious drawback with blocks of visiting cards (business cards) is that a card torn from the pad will have a perforated tear edge with paper fibres visible along the full extent of the edge. This results in a visiting card of somewhat "cheap and shoddy" appearance.

SUMMARY OF THE INVENTION

An object of the present invention is to solve the aforesaid problems.

According to a first aspect of the present invention, there is provided a method of manufacturing tearable sheets with which each sheet obtains a perfectly smooth tear edge when tom-off. The method comprises the steps of punching each sheet transversely of the sheet fibres from a first side to an extent that corresponds to a first portion of the total thickness of the sheet; and punching each sheet transversely of the sheet fibres from a second side of the sheet to an extent corresponding to a second portion of the sheet thickness, wherewith the sum of said first portion and said second portion of said sheet thickness is smaller than the full thickness of said sheet, and wherein the second sheet punching operation is effected parallel with the first sheet punching operation but with a displacement in a plane parallel with said first and second sides of the sheet adapted for tear-off purposes. This method provides a perfectly straight and clean tear edge when tearing-off a sheet, in the absence of visible paper fibres or any visible perforated edge. The sheets can therefore be used suitably as visiting cards or business cards, for example.

In this connection, a further advantage is obtained when said first portion corresponds to 30–50% of the sheet thickness and said second portion corresponds to 20–40% of the sheet thickness.

In another embodiment, a further advantage is afforded when said first portion of the sheet thickness corresponds to 40–50% of said thickness and said second portion of the sheet thickness corresponds to 30–40% of said thickness.

In another embodiment, a further advantage is afforded when said first portion corresponds to 50% of the sheet thickness and said second portion corresponds to 40% of the sheet thickness.

In another embodiment, a further advantage is afforded when said first portion corresponds to 40% of the sheet thickness and said second portion corresponds to 30% of said sheet thickness.

In this connection, a further advantage is obtained when said displacement or shift is 0.1–1.5 mm.

In another embodiment, a further advantage is obtained when said displacement is 0.1–1.0 mm.

In another embodiment, a further advantage is obtained when said displacement is 0.1–0.4 mm.

In another embodiment, a further advantage is obtained when said displacement is 0.35 mm.

In another embodiment, a further advantage is obtained when said displacement is 0.20 mm.

In this connection, a further advantage is afforded when punching is effected with the aid of hardmetal cutting lines.

A further advantage is afforded in this connection when the sheet is a paper sheet.

A further object of the present invention is to provide a method for the manufacture of a block or pad that includes tearable sheets produced in accordance with the method of manufacturing such sheets. The method comprises the steps of arranging a number of mutually stacked tearable sheets in a wrapper such that the first punching of each sheet takes place substantially in line and the second punching of the sheet takes place substantially in line;

applying at least one joining device for joining together the wrapper and the stacked sheets, wherein said at least one joining device is applied in that part of the sheet that does not consist of the tearable sheets;

folding back the wrapper so as to hide said at least one joining device;

applying a double-acting fastener to that part of the wrapper that forms the underside of said block; and fastening the rearwardly folded part of the wrapper to the underside of said block with the aid of said fastener.

This method results in a block that comprises tearable sheets, where tearing of a sheet results in a perfectly straight and clean tear edge in the absence of visible paper fibres or other visible perforated edge. A suitable area of use resides in a block consisting of tear-off visiting cards.

A further advantage is obtained in this connection, when the method also includes the step of arranging a transparent protective element on the mutually stacked tearable sheets.

A further advantage is obtained in this connection, when the transparent protective element is comprised of transparent plastic foil.

A further advantage is obtained in this connection, when said at least one fastener consists of a staple.

A further advantage is obtained in this connection, when the double-acting fastener consists of double-acting adhesive tape.

A further advantage is obtained in this connection, when the wrapper is comprised of paperboard.

Another object of the present invention is to provide a block or pad manufactured in accordance with the above method of manufacture. The inventive block results in a block consisting of tearable sheets, with which tearing of a sheet results in a perfectly straight and clean tear edge in the absence of visible paper fibres or other visible perforated edges.

It will be understood that when the term "includes/including" is used in this document, it shall be interpreted as indicating the presence of characteristic features, steps or components, and that it does not exclude the presence of one or more other characteristic features, parts, steps, components or groups thereof.

The invention will now be described with reference to exemplifying embodiments thereof and also with reference to the accompanying drawings.

BRIEF DESCRIPTION OF THE DRAWINGS

FIG. 1 is a flowchart illustrating a method of manufacturing tearable sheets in accordance with the present invention.

FIG. 2 is a flowchart illustrating a method of manufacturing a block or pad that comprises tearable sheets in accordance with the invention.

FIG. 3 is a side view of a sheet intended as an illustration of the method shown in FIG. 1.

FIG. 4 is a side view of a torn-off sheet in respect of a sheet manufactured in accordance with the method shown in FIG. 1.

FIGS. 5–8 are mutually different perspective views that illustrate the method of manufacture shown in FIG. 2.

FIG. 9 consists of two perspective views of a block or pad according to the present invention.

DETAILED DESCRIPTION OF EMBODIMENTS

FIG. 1 is a flowchart illustrating a method of manufacturing tearable sheets in accordance with the present invention. The method begins at the block 10. At block 12, the method continues with the step of punching each sheet transversely to the fibres of said sheet from a first side thereof to an extent or depth corresponding to a first portion of the thickness of the sheet. The method then continues at block 14 with the step of punching each sheet transversely of the sheet fibres from a second side of said sheet, down to an extent or a depth corresponding to a second portion of the thickness of said sheet, wherein the sum of said first and said second portions of the sheet thickness is smaller than the full thickness of the sheet. The second punching operation is effected parallel with the first punching operation, although with a displacement or shift in a plane parallel with said first and said second sides of the sheet adapted for tear-off purposes. The method is terminated at block 16. Compare also FIGS. 3 and 4.

According to one preferred embodiment of the method of manufacturing tearable sheets, said first portion 42 (c.f. FIG. 3) corresponds to 30–50% of the thickness b of the sheet 40, and said second portion 44 corresponds to 20–40% of the thickness b of said sheet 40.

According to another preferred embodiment of the method of manufacturing tearable sheets 40, said first portion 42 of the thickness b of the sheet 40 corresponds to 40–50% of the thickness of the sheet, and the second portion 44 of said sheet thickness b corresponds to 30–40% of the total sheet thickness.

According to another preferred embodiment of the method of manufacturing tearable sheets 40, said first portion 42 of the sheet thickness b corresponds to 50% of the thickness of the sheet 40, and said second portion of the sheet thickness b corresponds to 40% of the thickness of said sheet.

According to still a further preferred embodiment of the method of manufacturing tearable sheets 40, said first portion 42 of the sheet thickness b corresponds to 40% of the thickness of said sheet, and said second portion 44 of the sheet thickness b corresponds to 30% of the thickness of said sheet.

According to one preferred embodiment of the method of manufacturing tearable sheets 40, said displacement f (c.f. FIG. 3) corresponds to a shift in the range of 0.1–1.5 mm.

According to another preferred embodiment of the method of manufacturing tearable sheets 40, said displacement f corresponds to a shift in the range of 0.1–1.0 mm.

According to a further preferred embodiment of the method of manufacturing tearable sheets 40, said displacement f corresponds to a shift in the range of 0.1–0.4 mm.

According to another embodiment of the method of manufacturing tearable sheets 40, said displacement f corresponds to a shift of 0.35 mm.

According to a further preferred embodiment of the method of manufacturing tearable sheets 40, said displacement corresponds to a shift of 0.20 mm.

The punching operation performed in the inventive method of manufacturing tearable sheets 40 may, for instance, be carried out with a letterpress of the Diegelautomat type including hardmetal cutting lines, for instance Sandvik Dieflex.

The tearable sheet 40 is preferably a paper sheet 40.

FIG. 2 is a flowchart illustrating the manufacture of a block or pad that includes tearable sheets 40 manufactured in accordance with the method shown in FIG. 1. The method begins at block 20. The method then continues at block 22 with the step of arranging a plurality of mutually stacked tearable sheets in a wrapper, such that the first punching operation of each sheet will take place essentially in line and the second punching operation of each sheet will also take place essentially in line. The method then continues at block 24 with the step of applying at least one joining device for joining together the wrapper and the stacked sheets, said at least one joining device being applied in that portion of the sheets that does not consist of the tearable sheets (c.f. FIG. 5). The method then continues at block 26 with the step of folding the wrapper backwards, so that said at least one joining device will be hidden (c.f. FIG. 6). The method then continues at block 28 with the step of applying a double-acting fastener to that part of the wrapper which forms the underside of the block or pad (c.f. FIG. 7). The method then continues at block 30 with the step of fastening the rearwardly folded portion of the wrapper to the underside of the block, with the aid of said fastener. The method is terminated at block 32.

According to one preferred embodiment of the block manufacturing method, the method comprises the further steps of arranging a transparent protective element on the mutually stacked tearable sheets, said element then being disposed in a wrapper.

The transparent protective element is preferably a transparent plastic foil.

According to one preferred embodiment of the block manufacturing method, said at least one joining device is a staple.

According to one preferred embodiment of the block manufacturing method, the double-acting fastener consists of double-sided adhesive tape.

FIG. 3 is a side view of a sheet 40, intended to illustrate the method shown in FIG. 1. It will be seen from FIG. 3 that the sheet 40 has a total thickness b. The sheet 40 is first stacked transversely of the fibres of the paper to an extent corresponding to a first portion 42 of the thickness b of the sheet 40. This first portion 42 may, for instance, correspond to 30–50% of the sheet thickness b. This process is then repeated from the underside of the sheet, by punching the sheet 40 transversely to the fibres of the paper to an extent or depth corresponding to a second portion 44 of the sheet thickness b. This second portion 44 may correspond, e.g., to 20–40% of the sheet thickness b. As evident from FIG. 3, the two punching operations (represented by 42 and 44) are carried out parallel with one another but displaced f in a plane parallel with the outer side of the sheet 40.

FIG. 4 is a side view of, for example, a torn-off visiting card for a sheet 40 manufactured in accordance with the method illustrated in FIG. 1. In the illustrated case, the sheet has already been torn, resulting in a usable portion, e.g. a visiting card 40*b*, and an unusable portion 40*a*, called stub by way of example. The torn edge obtains a step-like appearance. The wavy lines, indicated at 46 for instance, illustrate schematically the fibres of the paper. As is evident from the figure, there is obtained a perfectly straight and clean tear edge in the absence of any visible paper fibres or other visible perforated edge.

It will be understood that the inventive method of manufacturing tearable sheets is not limited solely to visiting cards or business cards, but can also be applied to correspondence cards and calendars with which a corresponding function is desired.

FIGS. 5–8 are mutually different perspective views which illustrate the method of manufacture illustrated in FIG. 2, i.e. a method of producing a block or pad that includes tearable sheets manufactured in accordance with the method illustrated in FIG. 1 (c.f. also FIGS. 3 and 4). Subsequent to having punched the sheets 40, the sheets, for instance 20–30 in number, are provided uppermost with a transparent plastic foil 48 as protection in a wrapper made, for instance, of 150–300 gr paperboard. The stub, i.e. the unusable portion 40*a* of the sheet 40, and the wrapper 50 are then joined together with the aid of at least one staple 52. As will be seen from FIG. 6, the wrapper 50 is then folded back so as to cover (hide) the staple 52. As shown in FIG. 7, double-sided adhesive tape 54 is mounted on the underside of the block or pad 56, and the rearwardly folded part of the wrapper 50 is fastened to the underside of the block 56, as illustrated by the arrow 58. FIG. 8 illustrates the finished block or pad 56, ready for delivery.

FIG. 9 shows two perspective views of an inventive block or pad 56. In this example, a number of visiting cards have been torn from the block 56. The trap-like spine/stub is more apparent from the circled portion of the enlarged portion of FIG. 9.

It will be understood that the method of manufacturing a block or pad that includes tearable sheets is not solely limited to visiting cards, but can also be applied in the manufacture of correspondence cards and wall-mounted calendars for example, when corresponding functions are desired.

The invention is not restricted to the aforedescribed exemplifying embodiments thereof and the person skilled in this particular field will be aware that many modifications are possible within the scope of the accompanying Claims.

The invention claimed is:

1. A method of manufacturing tearable sheets of paper, each sheet of paper having fibres wherein each sheet of paper obtains a straight vertical tear edge and a stub when torn-off obtaining a step-like appearance, said method comprising the steps of punching via a hardmetal cutting line each sheet of paper transversely of the fibres of said sheet of paper from the first side of the sheet to a depth corresponding to a first portion of the thickness of the sheet; and punching via a hardmetal cutting line each sheet of paper transversely of the fibres of said sheet of paper from the second side of the sheet to a depth corresponding to a second portion of the thickness of said sheet;

wherein the sum of said first thickness portion and said second thickness portion is smaller than the thickness of the sheet, and wherein the second punching operation is performed parallel with the first punching operation but displaced in a plane parallel with said first and said second sides of the sheet, said displacement being adapted for tear-off purposes.

2. A method of manufacturing tearable sheets of paper according to claim 1, wherein said first thickness portion corresponds to 30–50% of the thickness of the sheet; and in that said second thickness portion corresponds to 20–40% of the thickness of said sheet.

3. A method of manufacturing tearable sheets of paper according to claim 2, wherein said first thickness portion corresponds to 40–50% of the thickness of the sheet; and in that said second thickness portion corresponds to 30–40% of the thickness of said sheet.

4. A method of manufacturing tearable sheets of paper according to claim 3, wherein said first thickness portion corresponds to 50% of the thickness of the sheet; and in that said second thickness portion corresponds to 40% of the thickness of said sheet.

5. A method of manufacturing tearable sheets of paper according to claim 3, wherein said first thickness portion corresponds to 40% of the thickness of the sheet; and in that said second thickness portion corresponds to 30% of the thickness of said sheet.

6. A method of manufacturing tearable sheets of paper according to claim 1, wherein said displacement corresponds to 0.1–1.5 mm.

7. A method of manufacturing tearable sheets of paper according to claim 6, wherein said displacement corresponds to 0.1–1.0 mm.

8. A method of manufacturing tearable sheets according to claim 7, wherein said displacement corresponds to 0.1–0.4 mm.

9. A method of manufacturing tearable sheets according to claim 8, wherein said displacement corresponds to 0.35 mm.

10. A method of manufacturing tearable sheets of paper according to claim 8, wherein said displacement corresponds to 0.20 mm.

11. A method of manufacturing a block or pad that includes tearable sheets, each sheet of paper having fibers wherein each sheet of paper obtains a straight vertical tear edge and a stub when torn-off obtaining a step-like appearance, said method comprising the steps of punching via a hardmetal cutting line each sheet of paper transversely of the fibres of said sheet of paper from the first side of the sheet to a death corresponding to a first portion of the thickness of the sheet; and punching via a hardmetal cutting line each sheet of paper transversely of the fibres of said sheet of paper from the second side of the sheet to a depth corresponding to a second portion of the thickness of said sheet;

wherein the sum of said first thickness portion and said second thickness portion is smaller than the thickness of the sheet, and wherein the second punching operation is performed parallel with the first punching operation but displaced in a plane parallel with said first and said second sides of the sheet, said displacement being adapted for tear-off purposes wherein the method further comprises the steps of arranging a plurality of mutually stacked tearable sheets of paper in a wrapper, so that the first punch in each sheet is disposed essentially in line, and the second punch in each sheet is disposed essentially in line; applying at least one joining device for joining the wrapper and the stacked sheets, wherein said at least one joining device is applied to that part of the sheets which are not formed by the tearable sheets;

bending the wrapper backwards so as to hide said at least one joining device;

applying a double-acting fastener to that part of the wrapper comprised of the underside of the block or pad; and fastening said rearwardly folded part of the wrapper to the underside of the block or pad with the aid of said fastener.

12. A method of manufacturing a block or pad according to claim 11, wherein that the method comprises the further step of providing a transparent protective element on the mutually stacked tearable sheets.

13. A method of manufacturing a block or pad according to claim 12, wherein the transparent protective element is comprised of a transparent plastic foil.

14. A method of manufacturing a block or pad according to claim 11, wherein said at least one joining device is a staple.

15. A method of manufacturing a block or pad according to claim 11, wherein said double-acting fastener is comprised of double-sided adhesive tape.

16. A method of manufacturing a block or pad according to claim 11, wherein that the wrapper is comprised of paperboard.

* * * * *